US011819471B2

(12) United States Patent
McArdle et al.

(10) Patent No.: US 11,819,471 B2
(45) Date of Patent: Nov. 21, 2023

(54) PHYSICAL THERAPY TOOLS

(71) Applicant: McArdle's Custom Engineering, Inc., Angola, IN (US)

(72) Inventors: Matthew McArdle, Angola, IN (US); Thomas McArdle, Ft Wayne, IN (US)

(73) Assignee: McArdle's Custom Engineering, Inc., Angola, IN (US)

( * ) Notice: Subject to any disclaimer, the term of this patent is extended or adjusted under 35 U.S.C. 154(b) by 442 days.

(21) Appl. No.: 16/698,017

(22) Filed: Nov. 27, 2019

(65) Prior Publication Data

US 2020/0163830 A1 May 28, 2020

Related U.S. Application Data

(60) Provisional application No. 62/772,297, filed on Nov. 28, 2018.

(51) Int. Cl.
*A61H 37/00* (2006.01)
*A61H 7/00* (2006.01)

(52) U.S. Cl.
CPC ..... *A61H 37/00* (2013.01); *A61H 7/003* (2013.01); *A61H 2201/0107* (2013.01); *A61H 2201/0153* (2013.01); *A61H 2201/1253* (2013.01)

(58) Field of Classification Search
CPC ..... A61H 39/06; A61H 39/04; A61H 2015/0014; A61H 7/003; A61H 37/00; A61H 7/007
See application file for complete search history.

(56) References Cited

U.S. PATENT DOCUMENTS 2,699,164 A * 1/1955 Hamilton ..... A61H 15/0092 D28/51
2,787,261 A * 4/1957 Mcdonald ..... A45D 40/00 601/19
4,432,136 A * 2/1984 Taylor ..... B26B 21/06 30/32
6,436,062 B1 * 8/2002 Iwamoto ..... A61H 15/00 601/122
10,722,424 B2 * 7/2020 Giraud ..... A61H 15/0085
2012/0041398 A1 * 2/2012 Wen ..... A61H 15/0092 604/310
2013/0018443 A1 * 1/2013 Lee ..... A61H 39/06 607/114
2015/0231014 A1 * 8/2015 Capobianco ..... B25F 1/00 7/151

(Continued)

*Primary Examiner* — Timothy A Stanis
*Assistant Examiner* — Matthew R Moon
(74) *Attorney, Agent, or Firm* — ALSTON & BIRD LLP

(57) ABSTRACT

A transformable physical therapy tool set is provided. The physical therapy tool set includes at least one receiving scraping tool defining a receiving tool handle portion and a receiving tool working portion. The receiving tool handle portion defines a tool insert to receive an insertable scraping tool at least partially therein and the receiving tool working portion defines a working edge for use with soft tissue mobilization. The physical therapy tool set also includes at least one insertable scraping tool defining an insertable tool handle portion and an insertable tool working portion configured to be received by the tool insert. The receiving scraping tool is operable in an instance in which the insertable scraping tool is inserted at least partially within the tool insert. A method of manufacturing the same are also provided.

17 Claims, 5 Drawing Sheets

(56) References Cited

U.S. PATENT DOCUMENTS

| | | | | |
|---|---|---|---|---|
| 2019/0209423 | A1* | 7/2019 | Mercenari Uribe | A63B 1/00 |
| 2020/0038282 | A1* | 2/2020 | Bui | A61H 7/001 |
| 2020/0138662 | A1* | 5/2020 | Powell | A61H 1/00 |

* cited by examiner

PHYSICAL THERAPY TOOLS

CROSS REFERENCE TO RELATED APPLICATION

This application claims the benefit of U.S. Provisional Application No. 62/772,297, filed Nov. 28, 2018, which application is hereby incorporated by reference in its entirety.

TECHNOLOGICAL FIELD

An example embodiment relates generally to physical therapy tools, and more particularly, example embodiments relate to physical therapy tools used for scraping exercises to allow for soft tissue mobilization.

BACKGROUND

Existing physical therapy tools are bulky, cumbersome to carry together, and are only made for large hand structures. The bulkiness of conventional physical therapy tools causes physical therapists with smaller hands to be unable to use the tools entirely or leads to improper tool use. Some tools are slippery and very difficult to grip. Others have very sharp edges, bruising the skin where scraped. Through applied effort, ingenuity, and innovation, many of these identified problems have been solved by developing solutions that are included in embodiments of the present disclosure, many examples of which are described in detail herein.

BRIEF SUMMARY

The following presents a simplified summary in order to provide a basic understanding of some aspects of the present disclosure. This summary is not an extensive overview and is intended to neither identify key or critical elements nor delineate the scope of such elements. Its purpose is to present some concepts of the described features in a simplified form as a prelude to the more detailed description that is presented later.

In an example embodiment, a transformable physical therapy tool is provided. The physical therapy tool includes at least one receiving scraping tool defining a receiving tool handle portion and a receiving tool working portion. The receiving tool handle portion defines a tool insert configured to receive an insertable scraping tool at least partially therein and the receiving tool working portion defines a working edge configured for use with soft tissue mobilization.

In some embodiments, the transformable physical therapy tool also includes at least one insertable scraping tool defining an insertable tool handle portion and an insertable tool working portion configured to be received by the tool insert. In such embodiments, the receiving scraping tool is operable in an instance in which the insertable scraping tool is inserted at least partially within the tool insert. In some embodiments, the insertable tool handle portion of the at least one insertable scraping tool includes a cylindrical shaft configured to be received by a given receiving scraping tool. In some embodiments, the insertable tool handle portion of the given insertable scraping tool also includes at least one gripping protrusion positioned radially along the cylindrical shaft. In such an embodiment, the insertable tool handle portion is configured to be at least one of a kneading tool or an ergonomic gripping surface.

In some embodiments, a first receiving scraping tool is configured to operably couple with a second receiving scraping tool. In some embodiments, the first receiving scraping tool also includes a tool engagement protrusion configured to removably couple to the second receiving scraping tool. In some embodiments, the tool engagement protrusion includes a hooking mechanism configured to engage with a handle aperture of the second receiving scraping tool. In some embodiments, the working edge of the first receiving scraping tool is one of a dull working edge or a sharp working edge and the working edge of the second receiving scraping tool is the opposite of the dull working edge or the sharp working edge. In some embodiments, the at least one receiving scraping tool includes a handle aperture. In some embodiments, the working edge of the at least one receiving scraping tool includes one of a sharp working edge or dull working edge. In some embodiments, the tool insert also includes a tool insert clipping mechanism.

In another example embodiment, a method of manufacturing a transformable physical therapy tool is provided. The method includes providing at least one receiving scraping tool defining a receiving tool handle portion and a receiving tool working portion. The method also includes defining a tool insert in the receiving tool handle portion of the at least one receiving scraping tools configured to receive an insertable scraping tool at least partially therein. The method further includes defining a working edge on the receiving tool working portion configured for use with soft tissue mobilization.

In some embodiments, the method also includes providing at least one insertable scraping tool defining an insertable tool handle portion and an insertable tool working portion configured to be received by the tool insert. In such an embodiment, the receiving scraping tool is operable in an instance in which the insertable scraping tool is inserted. In some embodiments, the insertable tool handle portion of the at least one insertable scraping tool includes a cylindrical shaft configured to be received by the at least one receiving scraping tool. In some embodiments, the insertable tool handle portion of the insertable scraping tool also includes at least one gripping protrusion positioned radially along the cylindrical shaft. In such an embodiment, the insertable tool handle portion of the insertable scraping tool is configured to be at least one of a kneading tool or an ergonomic gripping surface.

In some embodiments, a first receiving scraping tool is configured to operably couple with a second receiving scraping tool. In some embodiments, the first receiving scraping tool also includes a tool engagement protrusion configured to removably couple to the second receiving scraping tool. In some embodiments, the tool engagement protrusion includes a hooking mechanism configured to engage with a handle aperture of the second receiving scraping tool. In some embodiments, the method also includes defining a handle aperture through the at least one receiving scraping tool. In some embodiments, the working edge of the at least one receiving scraping tool includes one of a sharp working edge or dull working edge.

The above summary is provided merely for purposes of summarizing some example embodiments to provide a basic understanding of some aspects of the disclosure. Accordingly, it will be appreciated that the above-described embodiments are merely examples and should not be construed to narrow the scope or spirit of the disclosure in any way. It will be appreciated that the scope of the disclosure encompasses many potential embodiments in addition to those here summarized, some of which will be further described below.

BRIEF DESCRIPTION OF THE DRAWINGS

Figures 1A, 1B:
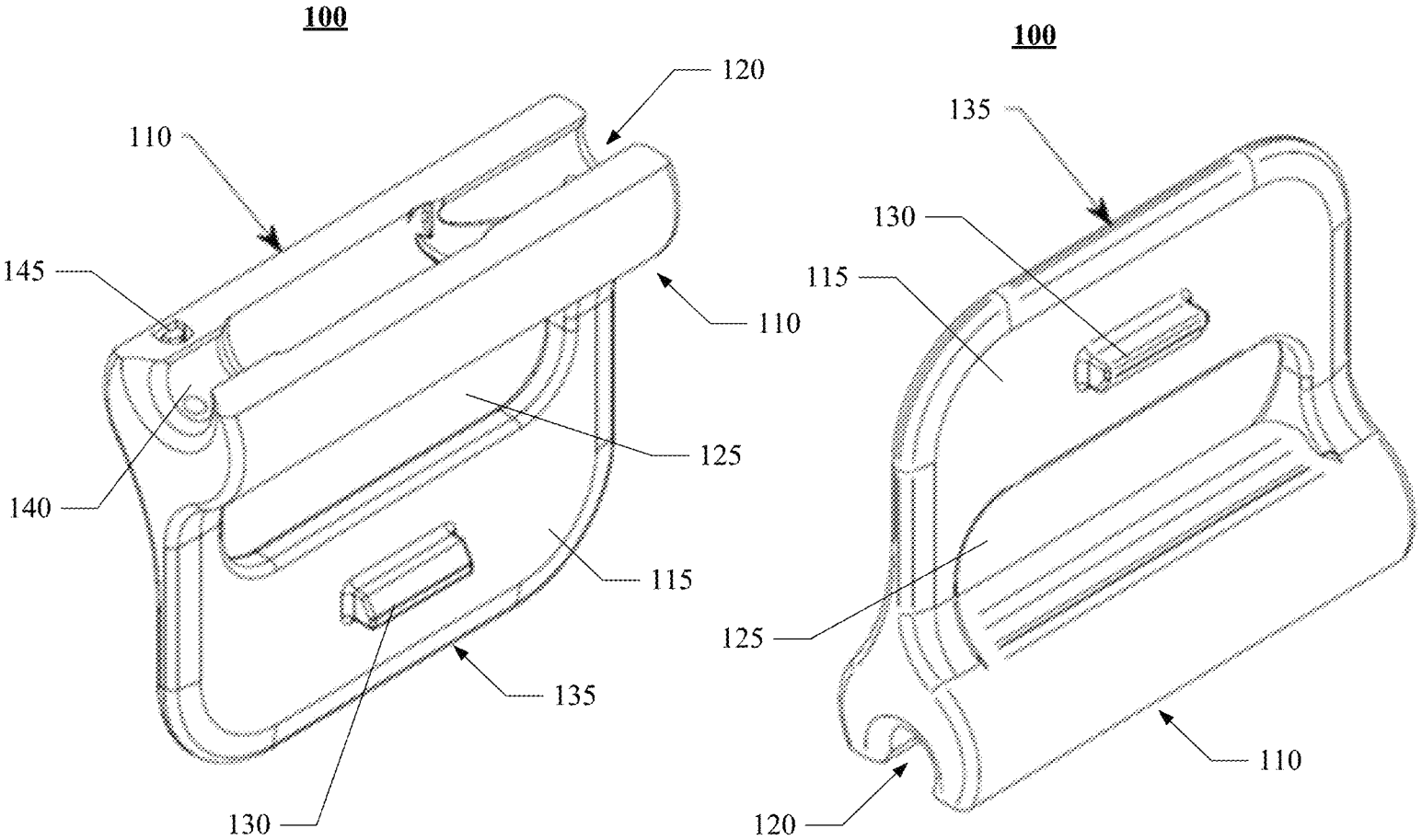
Figure 2B:
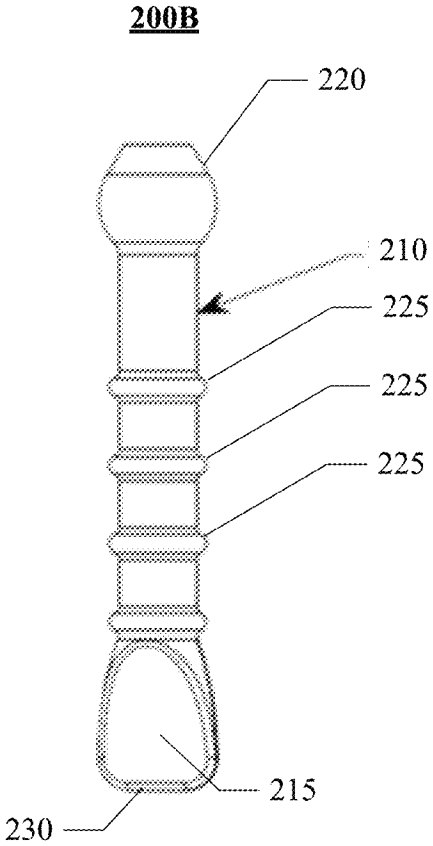
Figure 2A:
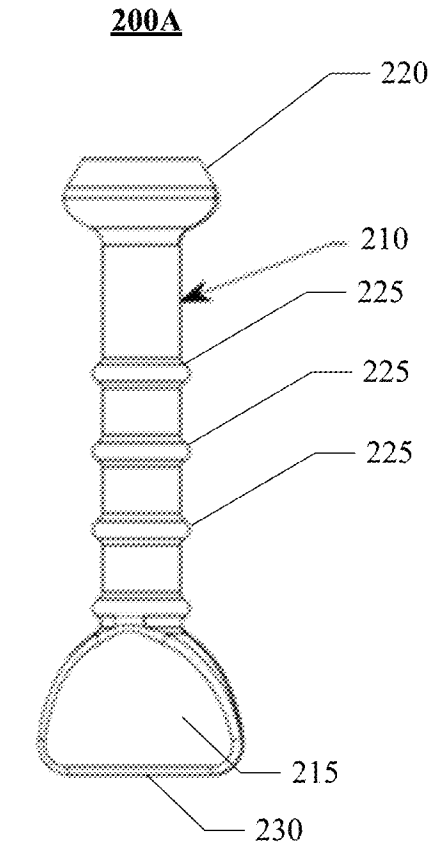
Figure 3B:
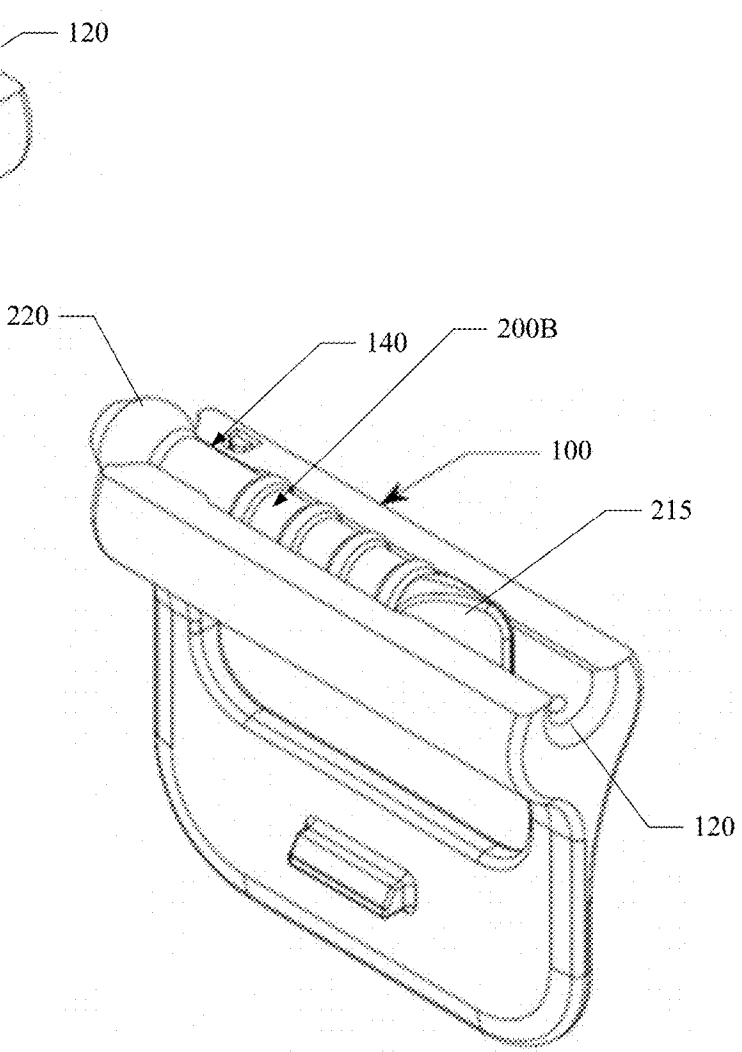
Figure 3A:
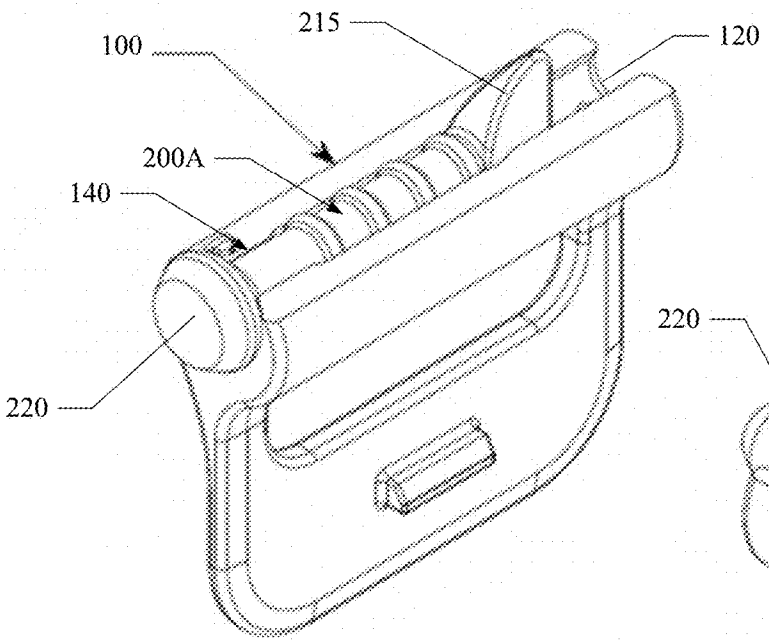
Figure 4:
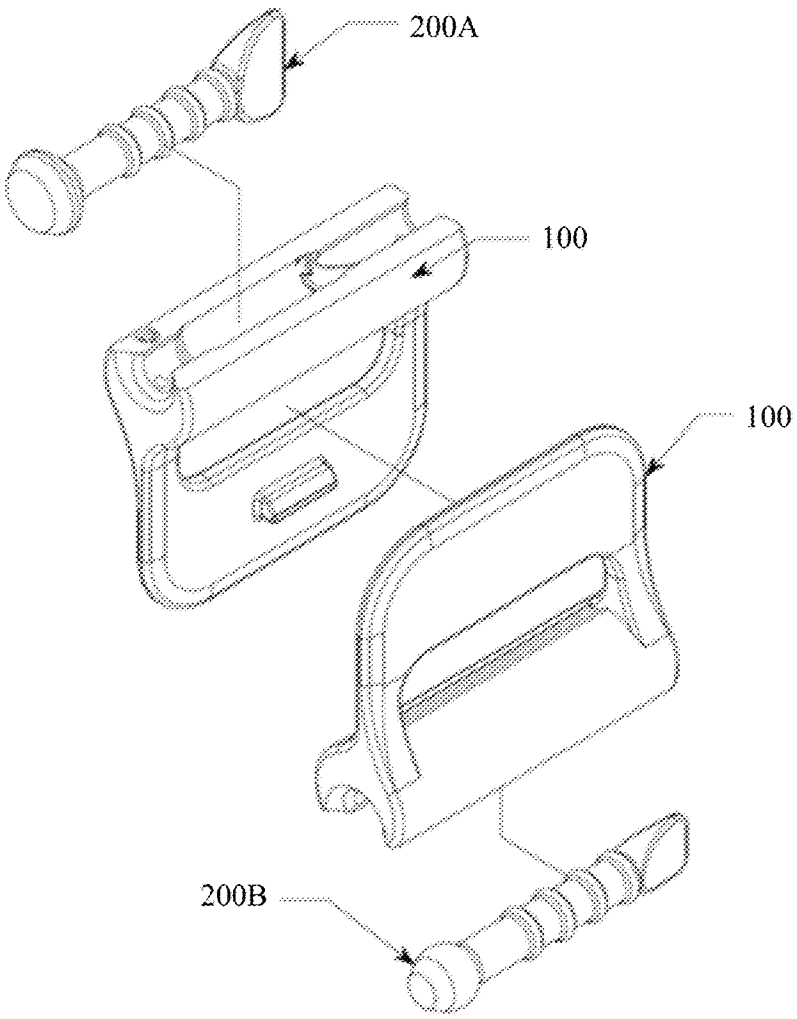
Figure 5A:
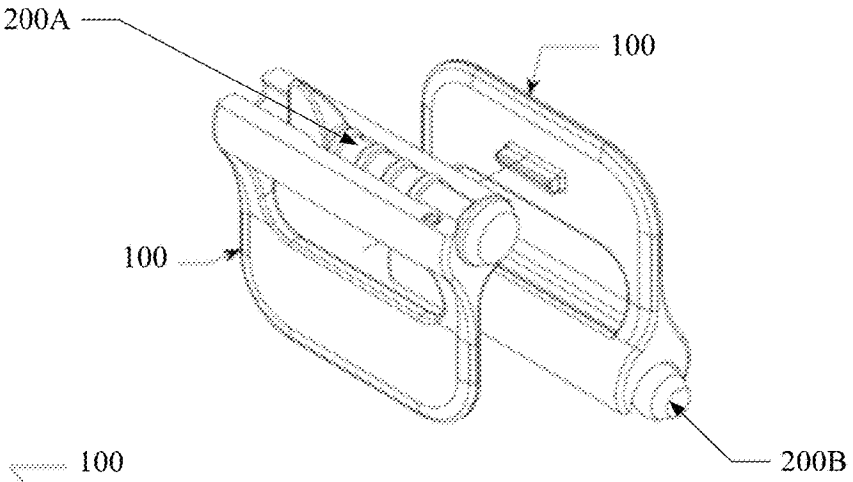
Figure 5B:
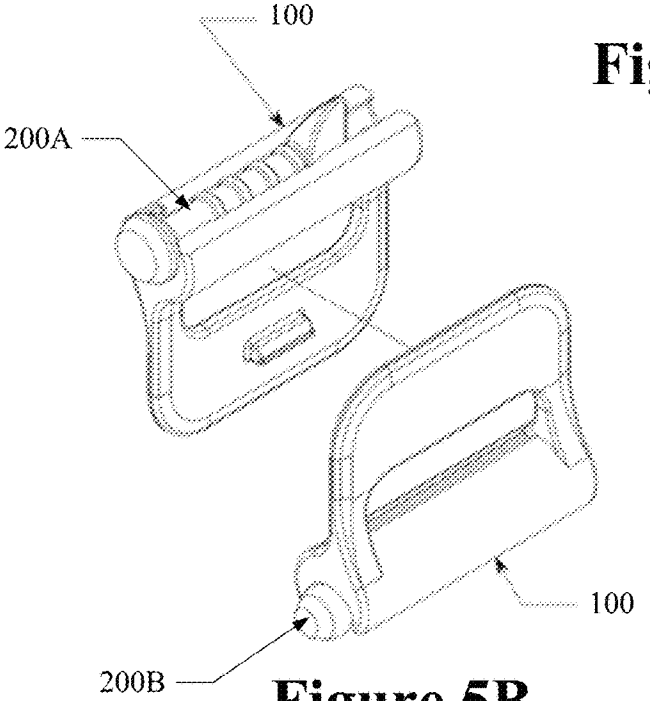

Having thus described certain example embodiments of the present disclosure in general terms, reference will hereinafter be made to the accompanying drawings, which are not necessarily drawn to scale, and wherein:

FIGS. 1A-1B illustrates different views of a receiving scraping tool in accordance with an example embodiment of the present disclosure;

FIGS. 2A-2B illustrates two example embodiments of an insertable scraping tool in accordance with the present disclosure;

FIGS. 3A-3B illustrates the insertable scraping tools of FIGS. 2A-2B inserted into the tool insert of a receiving scraping tool, such as the receiving scraping tool of FIG. 1 in accordance with the present disclosure;

FIG. 4 is an exploded view of a physical therapy tool set configured to removably couple to one another in accordance with the present disclosure; and FIGS. 5A-5B illustrate multiple views of the physical therapy tool set of FIG. 4 being assembled together in accordance with the present disclosure.

DETAILED DESCRIPTION

The present disclosure now will be described more fully hereinafter with reference to the accompanying drawings in which some but not all embodiments are shown. Indeed, these various embodiments of the disclosure may be embodied in many different forms and should not be construed as limited to the embodiments set forth herein; rather, these embodiments are provided so that this disclosure will satisfy applicable legal requirements. Like numbers refer to like elements throughout. As used herein, terms such as "front," "rear," "top," etc. are used for explanatory purposes in the examples provided below to describe the relative position of certain components or portions of components. Furthermore, as would be evident to one of ordinary skill in the art in light of the present disclosure, the terms "substantially" and "approximately" indicate that the referenced element or associated description is accurate to within applicable engineering tolerances.

The components illustrated in the figures represent components that may or may not be present in various embodiments of the disclosure described herein such that embodiments may include fewer or more components than those shown in the figures while not departing from the scope of the disclosure. Some components may be omitted from one or more figures or shown in dashed line for visibility of the underlying components.

The terminology used herein is for the purpose of describing particular embodiments only and is not intended to be limiting of the disclosure. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of the stated features, steps, operations, elements, and/or components, but do not prelude the presence or addition of one or more other features, steps, operations, elements, components, and/or groups thereof.

Unless otherwise defined, all terms (including technical and scientific terms) used herein have the same meaning as commonly understood by one having ordinary skill in the art to which this disclosure belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so denied herein.

The present disclosure is to be considered as an exemplification of the various embodiments, and is not intended to limit the disclosure to the specific embodiments illustrated by the figures or description below. The terms large and small are used in relative terms and are not meant to be limiting.

Overview

Instrumental soft tissue mobilization has been used by physical and massage therapists around the world to assess soft tissue. Traditional tools are used to glide over the tissue to assess and address fibrosis connective tissue. However, in order to effectively treat multiple areas, traditional tools often come in sets of different shapes, sizes, and/or other characteristics. However, these traditional tools may be difficult to use and also often require large carrying containers. Various embodiments of the present disclosure define multiple tools used in scraping exercises (e.g., for soft tissue mobilization) intended for the use in physical therapy that are configured to be removably coupled to one another in order to be easily carried without reducing the effectiveness of traditional tools.

The tools of an example embodiment consist of at least one larger receiving scraping tool mating to at least one smaller insertable scraping tool. The tools may be removably coupled to one another such that the tools may be joined together to form various sub-assembly(s) and ultimately join the sub-assemblies together to form an interconnected assembly. The tools described herein may be used with or without a massage lotion of choice that is compatible with the patient. The tools defined here may be customizable in size to fit many different hand sizes. The tools can contain a customizable edge (i.e. a sharp, dull, or radiused edge) on both receiving and insertable tools.

FIGS. 1A-B: Receiving Scraping Tool

FIGS. 1A and 1B illustrate a receiving scraping tool of an example embodiment. As shown, various embodiments of a receiving scraping tool 100 may include a receiving tool handle portion 110 and a receiving tool working portion 115. In various embodiments, the receiving tool handle portion 110 and the receiving tool working portion 115 may form a unitary tool (e.g., the receiving scraping tool made be made out of one piece of material, such as a hard plastic, for example via a molding process). In various embodiments, the receiving scraping tools may be made of wood, metal, ceramic, or the like.

In some embodiments, the receiving tool handle portion 110 of the receiving scraping tool 100 may include a tool insert 120 configured to receive an insertable scraping tool, such as the insertable scraping tools 200A, 200B discussed in reference to FIGS. 2A and 2B. The tool insert 120 may be a generally cylindrical cavity based on the size of various insertable scraping tools. In some embodiments, as shown, the tool insert 120 may be configured to force fit an insertable scraping tool. For example, an insertable scraping tool 200A, 200B may be maintained with the tool insert 120 via a friction fit. For example, the receiving tool handle portion 110 may be made out of a material that may allow the insertable scraping tool to be inserted into the tool insert 120 and as such, then forcibly holds the insertable scraping tool in place during operation of the receiving scraping tool.

In some embodiments, the receiving tool handle portion 110 may be configured to fit within the palm of a user's hand. For example, the receiving tool handle portion 110 may be a size such that an average person may grip the receiving tool handle portion 110 with relative ease.

In various embodiments, the tool insert 120 may have a varying cross-sectional profile, such as to accommodate the shape of an insertable scraping tool. In some embodiments, the tool insert 120 may include a tool insert clipping mechanism 140. In some embodiments, the tool insert clipping mechanism 140 may include a reduced cross-sectional area such as to exert an additional force on an insertable scraping tool. Additionally, the tool insert clipping mechanism 140 may have an unlocking mechanism configured to release an inserted insertable scraping tool 200A, 200B from the tool insert 120. For example, the receiving scraping tool 100 may have a tool insert clip activation mechanism 145 that may activate the unlocking mechanism upon engagement from a user.

In some embodiments, the receiving scraping tool 100 may have a handle aperture 125 disposed near the receiving tool handle portion 110, such that the handle aperture may allow for a user to grip the receiving tool handle portion 110 during operation of the receiving scraping tool 100. In various embodiments, the handle aperture 125 may be sufficiently large to receive one or more fingers of a user during operation.

In some embodiments, the receiving tool working portion 115 of the receiving scraping tool 100 may be a generally thin, wide shape. For example, the receiving scraping tool 100 may be from approximately 5 centimeters to 15 centimeters tall, approximately 8 centimeters to 16 centimeters wide, and approximately 0.05 centimeters to 1 centimeter thick. In some embodiments, the receiving tool working portion 115 may be generally shaped like a spade. In various embodiments, the receiving tool working portion 115 may have a working edge 135 configured to engage with skin (e.g., skin of a patient or client) during operation in order to provide treatment (e.g., to the patient or client). The working edge 135 may have different types of edges based on the application used. For example, the working edge 135 may be generally sharp or dull. In various embodiments, the working edge 135 may have a radiused edge. In an example embodiment, a set of tools may include a first receiving scraping tool 100 having a generally sharp working edge 135 and a second receiving scraping tool 100 having a generally dull working edge 135 (or vice versa).

In an example embodiment, the working portion 115 also includes a tool engagement protrusion 130 discussed in more detail below relating to the combination of two receiving scraping tools (e.g., FIGS. 4-5B). For example, the receiving tool working portion 115 of the first or second receiving tool 100 may include a tool engagement protrusion 130 that may be used to couple the first and second receiving scraping tools 100 to one another.

In various embodiments, the receiving scraping tool 100 may be used for treatment regardless of whether an insertable scraping tool is inserted within the tool insert 120 of the receiving scraping tool 100. In some embodiments, in an instance in which an insertable scraping tool 200A, 200B is inserted at least partially within the tool insert 120, the receiving scraping tool may be sturdier during operation. For example, a user may be able to grip the receiving tool 100 easier in an instance the insertable tool is inserted. In various embodiments, the receiving scraping tool may be used to glide or scrap over the skin of a patient or client. For example, the receiving scraping tool 100 may be applied over an entire area of a patient or client's arm, shoulder, thigh, calf, and/or plantar surface of the foot. The receiving scraping tool may be configured to allow for being scraped along a patient or client's skin at approximately 30-45 degree angle. For example, the receiving scraping tool 100 may be held, while being scraped along a patient or client's skin, such that a plane defined by the receiving scraping tool and the surface of the patient or client's skin forms a use angle. In various embodiments, the use angle is in the range of approximately 30-45 degrees. In some embodiments, the proper angle of application may be based on the shape of the working edge 135 (e.g., whether the working edge 135 is sharp or dull). While many different stroking methods can be used, as well-known by physical therapists and other practitioners in the art, one exemplary stroking method is 2-3 strokes up and then 2-3 strokes down, each at a use angle.

FIGS. 2A-B: Insertable Scraping Tool

FIGS. 2A and 2B illustrate two example insertable scraping tools 200A, 200B of the present disclosure. As shown in FIGS. 2A and 2B, the insertable scraping tools may each have an insertable tool handle portion 210 and an insertable tool working portion 215. In various embodiments, the insertable tool handle portion 210 and the insertable tool working portion 215 may be a unitary piece. For example, the insertable scraping tools 200A, 200B may be molded out of a hard plastic. In various embodiments, the insertable scraping tools may be made of wood, metal, ceramic, or the like.

In various embodiments, the insertable tool handle portion 210 of an insertable scraping tool 200A, 200B may be generally cylindrical in shape. In some embodiments, the insertable tool handle portion 210 may have a radius such that an average user could easily fit the insertable tool handle portion 210 of the insertable scraping tool 200 in their palm. In some embodiments, the insertable tool handle portion 210 may also include one or more gripping protrusions 225 configured radially on the insertable tool handle portion 210. For example, as shown in FIGS. 2A and 2B, the insertable tool handle portion 210 may have three gripping protrusions 225. In various embodiments, the gripping protrusions 225 may assist the user in gripping the insertable scraping tool 200 during use.

In some embodiment, insertable tool handle portion 210 may also include a handle end 220. In some embodiments, the handle end 220 may be used as a kneading tool (e.g., in conjunction with the insertable tool working portion 215. As shown in FIGS. 2A and 2B, the handle end 220 may have various mushroom shapes based on the intended application. In some embodiments, the handle end 220 may be configured based on the size of an average palm (e.g., so that the handle end 220 fits into a user's hand during operation) and/or the type of kneading intended to be performed using a given tool. For example, the handle end 220 may be used for kneading and may be rounded into a generally spherical shape.

In various embodiments, the insertable tool working portion 215 of an insertable scraping tool 200A, 200B may have a generally wide, flat structure. In some embodiments, the insertable tool working portion 215 may be the general shape of a spade. As shown in FIGS. 2A and 2B, the working portion 215 may have different shapes (e.g., widths) based on the intended application. For example, an insertable scraping tool 200A, 200B may be shaped such that it is easier for a user to target specific areas and/or can be used for smaller areas, such as fingers or toes. For example, the working portion 215 may be approximately 2 centimeters to 5 centimeters wide (e.g., 3 centimeters wide), and approximately 0.05 centimeters to 1 centimeter thick. The insertable tool working portion 215 may extend from the insertable tool handle portion 210 and terminate at a working edge 230. The shape of the working edge 230 of an insertable scraping tool may be dependent on the intended use. For example, the working edge 230 of an insertable scraping tool may be sharp or dull.

In some embodiments, the working edge 230 of the insertable scraping tool 200A, 200B may be inoperable in an instance in which the insertable scraping tool is inserted into the tool insert 120 of the receiving scraping tool 100 as discussed above. In some embodiments, the insertable scraping tool 200A, 200B may optionally be used in sequence with the receiving tool, or individually, to provide treatment to areas that need more specific targeting. In some embodiments, the insertable scraping tool 200A, 200B may be used for treating smaller areas, such as finger and toes as well as specific muscle insertions and organs.

FIGS. 3A-3B: Combined Sub-Assemblies

FIG. 3A illustrates the insertable scraping tool 200A inserted into the tool insert 120 of a receiving scraping tool 100 in accordance with an example embodiment. As shown, the insertable scraping tool 200A may be inserted into the tool insert 120 such that the handle end 220 may not be within the tool insert 120. In some embodiments, the gripping protrusions 225 may engage with the tool insert 120 to assist in holding the insertable scraping tool 200A in place within the tool insert 120. As shown, part of the insertable tool working portion 215 of the insertable scraping tool 200A may protrude from the tool insert 120. In some embodiments, the tool insert 120 may be configured to provide higher cross-sectional area where the insertable tool working portion 215 will be inserted to allow the insertable scraping tool 200A to stay steady in the tool insert 120 (e.g., to prevent the insertable scraping tool 200A from accidentally becoming uncoupled from the tool insert 120 due to the insertable tool working portion 215 being bumped). Additionally, the tool insert clipping mechanism 140 may engage with the insertable tool handle portion 210 of the insertable scraping tool 200A. As shown in FIG. 3B, in some embodiments, the tool insert 120 of the receiving scraping tool 100 may be structured to allow different shaped insertable scraping tools (e.g., insertable scraping tool 200B) to be coupled at least partially therein. For example, the tool insert 120 may be configured to allow multiple shaped insertable scraping tools 200A, 200B. In some embodiments, as discussed below in reference to FIGS. 4-5B, a physical therapy tool set may include a plurality of receiving scraping tools 100 and/or insertable scraping tools (e.g., insertable scraping tools 200A, 200B). The receiving scraping tool 100 may be configured to allow the insertable scraping tools 200A, 200B to be easily inserted and retained at least partially within the tool insert 120 and easily removed from the tool insert 120 by a user. In an example embodiment, the receiving scraping tool 100 is configured to avoid and/or prevent unintended separation of the tools during use of the receiving scraping tool 100. Additionally, the insertable scraping tools 200A, 200B (e.g., the insertable tool handle portion 210) may provide additional gripping ability for a user during operation of a receiving scraping tool 100 having the insertable scraping tool 200A, 200B coupled at least partially therein (e.g., at least partially within the tool insert 120). In some embodiments, various tools (e.g., receiving scraping tool(s) 100 and/or insertable scraping tool(s) 200A, 200B) may include optional writing customization, logo, branding, or media content printed thereon and/or adhered thereto.

FIGS. 4-5B: Interconnected Assembly

FIG. 4 illustrates an exploded view of a physical therapy tool set that may be coupled together into an interconnected assembly, in accordance with an example embodiment. In an example embodiment, the physical therapy tool set may include two receiving scraping tools 100 and two insertable scraping tools (e.g., 200A and/or 200B). Each of the two receiving scraping tools may have an insertable scraping tool coupled at least partially within the tool insert thereof and the two receiving scraping tools may be coupled to one another to provide an interconnected assembly.

In some embodiments, the individual receiving scraping tools 100 may include different working portions 115. For example, the receiving scraping tools 100 may have different shaped working edges 135 (e.g., a first receiving scraping tool may have a sharp working edge and a second receiving scraping tool may have a dull working edge (or vice versa)). In some embodiments, the tool insert 120 of each of the two receiving scraping tools 100 may be configured to hold a different insertable scraping tool. For example, the tool insert 120 of a first receiving scraping tool 100 may be optimized for coupling a first insertable scraping tool 200A at least partially therein, while the tool insert 120 of a second receiving scraping tool may be optimized for coupling a second insertable scraping tool 200B at least partially therein. Alternatively, the tool inserts 120 may be uniform (e.g., the first and second receiving scraping tools may have substantially and/or approximately the same tool inserts 120) and the tool inserts 120 may be configured to hold two or more different shaped insertable scraping tools. For example, the tool inserts 120 for both the first and second receiving scraping tools 100 may be configured to receive both insertable scraping tools 200A, 200B individually (e.g., one at a time).

As shown in FIGS. 5A and 5B, the two receiving scraping tools 100 may be configured to removably couple with one another (e.g., such as for storage or travel with the physical therapy tool set). As shown, in some embodiments, the tool engagement protrusion 130 of each receiving scraping tool may engage with the handle aperture 125 of another receiving scraping tool, such that the tool engagement protrusion 130 hooks or otherwise attaches to the handle aperture 125.

Removably coupling the two receiving scraping tools allows for the physical therapy tool set to pack in a compact fashion, such as for travel. Once coupled, a user may exert a force on the receiving scraping tools to detach them from one another, at which point each receiving scraping tool may be used as discussed herein. Additionally, the insertable scraping tool 200A, 200B may be easily removed from the receiving scraping tools in order to use the insertable scraping tool in conjunction with treatment. In an example embodiment, an insertable scrapping tool may be removed from the tool insert 120 of a receiving scraping tool while the receiving scraping tool is coupled to another receiving scraping tool.

Although the various embodiments have been illustrated and described herein with reference to preferred embodiments and specific examples thereof, it will be clear to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

Many modifications and other embodiments set forth herein will come to mind to one skilled in the art to which these disclosure pertain having the benefit of the teachings presented in the foregoing descriptions and the associated drawings. Therefore, it is to be understood that the disclosure are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A transformable physical therapy tool, the physical therapy tool comprising:

at least one receiving scraping tool defining a receiving tool handle portion and a receiving tool working portion, wherein the receiving tool handle portion defines a tool insert configured to receive an insertable scraping tool at least partially therein, the tool insert comprising a clipping mechanism and a generally cylindrical cavity and defining a tool insert opening configured for receiving the insertable scraping tool therethrough, the receiving tool working portion defines a working edge, wherein the working edge is configured for engaging a patient's skin to perform soft tissue mobilization, and the tool insert opening is directed opposite the working edge; and at least one insertable scraping tool defining an insertable tool handle portion that is generally cylindrically-shaped and an insertable tool working portion that is generally blade-shaped, wherein the at least one insertable scraping tool is configured to be received by the tool insert, such that the receiving scraping tool is operable in an instance in which the insertable scraping tool is inserted at least partially within the tool insert.

2. The transformable physical therapy tool of claim 1, wherein the insertable tool handle portion of the at least one insertable scraping tool comprises a cylindrical shaft configured to be received by a given receiving scraping tool.

3. The transformable physical therapy tool of claim 2, wherein the insertable tool handle portion of the given insertable scraping tool further comprises at least one gripping protrusion positioned radially along the cylindrical shaft, wherein the insertable tool handle portion is configured to be at least one of a kneading tool or an ergonomic gripping surface.

4. The transformable physical therapy tool of claim 1, wherein a first receiving scraping tool is configured to operably couple with a second receiving scraping tool.

5. The transformable physical therapy tool of claim 4, wherein the first receiving scraping tool further comprises a tool engagement protrusion configured to removably couple to the second receiving scraping tool.

6. The transformable physical therapy tool of claim 5, wherein the tool engagement protrusion is configured to engage with a handle aperture of the second receiving scraping tool.

7. The transformable physical therapy tool of claim 4, wherein the working edge of the first receiving scraping tool is one of (a) a dull working edge or (b) a sharp working edge and the working edge of the second receiving scraping tool is the other one of (a) the dull working edge or (b) the sharp working edge.

8. The transformable physical therapy tool of claim 1, wherein the at least one receiving scraping tool comprises a handle aperture.

9. The transformable physical therapy tool of claim 1, wherein the working edge of the at least one receiving scraping tool comprises one of a sharp working edge or dull working edge.

10. A method of manufacturing a transformable physical therapy tool, the method comprising:

providing at least one receiving scraping tool defining a receiving tool handle portion and a receiving tool working portion;

defining a tool insert in the receiving tool handle portion of the at least one receiving scraping tools configured to receive an insertable scraping tool at least partially therein, the tool insert comprising a clipping mechanism and being a generally cylindrically-shaped cavity and defining a tool insert opening configured for receiving the insertable scraping tool therethrough;

defining a working edge on the receiving tool working portion, wherein the working edge is configured for engaging a patient's skin to perform soft tissue mobilization, wherein the working edge is directed opposite the tool insert opening; and providing at least one insertable scraping tool defining an insertable tool handle portion that is generally cylindrical and an insertable tool working portion that is generally blade-shaped, the insertable scraping tool configured to be received by the tool insert, such that the receiving scraping tool is operable in an instance in which the insertable scraping tool is inserted.

11. The method of claim 10, wherein the insertable tool handle portion of the at least one insertable scraping tool comprises a cylindrical shaft configured to be received by the at least one receiving scraping tool.

12. The method of claim 11, wherein the insertable tool handle portion of the insertable scraping tool further comprises at least one gripping protrusion positioned radially along the cylindrical shaft, wherein the insertable tool handle portion of the insertable scraping tool is configured to be at least one of a kneading tool or an ergonomic gripping surface.

13. The method of claim 10, wherein a first receiving scraping tool is configured to operably couple with a second receiving scraping tool.

14. The method of claim 13, wherein the first receiving scraping tool further comprises a tool engagement protrusion configured to removably couple to the second receiving scraping tool.

15. The method of claim 14, wherein the tool engagement protrusion is configured to engage with a handle aperture of the second receiving scraping tool.

16. The method of claim 10, further comprising defining a handle aperture through the at least one receiving scraping tool.

17. The method of claim 10, wherein the working edge of the at least one receiving scraping tool comprises one of a sharp working edge or dull working edge.

* * * * *